US012766390B2

(12) United States Patent
Wirtz

(10) Patent No.: US 12,766,390 B2
(45) Date of Patent: Oct. 20, 2026

(54) TOSS GAME APPARATUSES AND GAMEPLAY METHODS

(71) Applicant: Thomas Wirtz, Milwaukie, OR (US)

(72) Inventor: Thomas Wirtz, Milwaukie, OR (US)

( * ) Notice: Subject to any disclaimer, the term of this patent is extended or adjusted under 35 U.S.C. 154(b) by 533 days.

(21) Appl. No.: 18/210,863

(22) Filed: Jun. 16, 2023

(65) Prior Publication Data

US 2023/0405430 A1 Dec. 21, 2023

Related U.S. Application Data

(60) Provisional application No. 63/352,966, filed on Jun. 16, 2022.

(51) Int. Cl.
*A63B 67/06* (2006.01)

(52) U.S. Cl.
CPC ..... *A63B 67/06* (2013.01); *A63B 2067/063* (2013.01); *A63B 2210/50* (2013.01)

(58) Field of Classification Search
CPC ..... A63B 67/06; A63B 2067/063; A63B 2210/50; A63B 63/00; A63B 65/10; A63B 2071/024; A63B 71/02; A63B 71/023
See application file for complete search history.

(56) References Cited

U.S. PATENT DOCUMENTS

| | | | | |
|---|---|---|---|---|
| 4,319,428 | A * | 3/1982 | Fox | A01G 17/04 47/42 |
| 4,635,943 | A * | 1/1987 | Lumpkin | A63B 67/06 473/588 |
| 4,989,880 | A * | 2/1991 | Gettemeier | A63B 67/06 273/DIG. 30 |
| 5,452,903 | A * | 9/1995 | Larrabee | A63B 63/00 273/400 |
| 6,142,890 | A * | 11/2000 | Craig | A63B 63/08 473/433 |
| 8,905,870 | B1 * | 12/2014 | Stafford | A63B 63/00 473/454 |
| 11,331,550 | B1 * | 5/2022 | Showalter | A63B 71/0669 |
| 2009/0143175 | A1 * | 6/2009 | Tarng | A63B 67/00 473/470 |

* cited by examiner

*Primary Examiner* — Michael D Dennis
(74) *Attorney, Agent, or Firm* — Mohr Intellectual Property Law Solutions PC

(57) ABSTRACT

Toss game apparatuses including a base member, a target hanger system, and a loop target assembly. The target hanger system is selectively mounted to the base member and projects away from the base member. The target hanger system is configured to releasably support a hanging target until the hanging target is struck by a tossed object to release the hanging target. The loop target assembly is selectively mounted to the base member above the target hanger system. The loop target assembly includes a spine, and a cord. The spine extends from the base member. The cord secures to the spine at each terminal end of the cord to define a loop target.

19 Claims, 7 Drawing Sheets

TOSS GAME APPARATUSES AND GAMEPLAY METHODS

CROSS REFERENCE TO RELATED APPLICATIONS

The present application claims priority to U.S. Provisional Patent Application, Ser. No. 63/352,996, filed on Jun. 16, 2022, the entire disclosure of which is incorporated by reference herein.

BACKGROUND

The present disclosure relates generally to recreational activities in the form of games. In particular, toss game apparatuses and gameplay methods are described.

Outdoor games are popular recreational activities. One popular category of outdoor games is toss games. Toss games typically involve tossing or throwing something, such as a ball, bag, or flying disk, at a designated target. Some toss games are played at relatively close range, such as corn hole, whereas other toss games are played over considerable distances, such as Frisbee golf.

Frisbee golf is a popular toss game, but is not always convenient to play. For example, one may have to travel to a dedicated Frisbee golf course to play. Players can purchase a Frisbee golf target to set up and use in a desired location, but Frisbee golf targets tend to be large, heavy, cumbersome, and inconvenient to transport. It would be desirable to have a portable toss game target that was easy to transport.

The Frisbee golf game itself has opportunities for improvement. For example, Frisbee golf requires a relatively high level of skill and has a relatively narrow scoring paradigm. A game similar to Frisbee golf with modified gameplay rules and unique equipment could provide new and exciting gameplay suitable for players of all ages and abilities.

Thus, there exists a need for toss game apparatuses and gameplay methods that improve upon and advance the design of known toss games. Examples of new and useful toss game apparatuses and gameplay methods relevant to the needs existing in the field are discussed below.

SUMMARY

The present disclosure is directed to toss game apparatuses including a base member, a target hanger system, and a loop target assembly. The target hanger system is selectively mounted to the base member and projects away from the base member. The target hanger system is configured to releasably support a hanging target until the hanging target is struck by a tossed object to release the hanging target. The loop target assembly is selectively mounted to the base member above the target hanger system. The loop target assembly includes a spine, and a cord. The spine extends from the base member. The cord secures to the spine at each terminal end of the cord to define a loop target.

DETAILED DESCRIPTION

Figure 1:
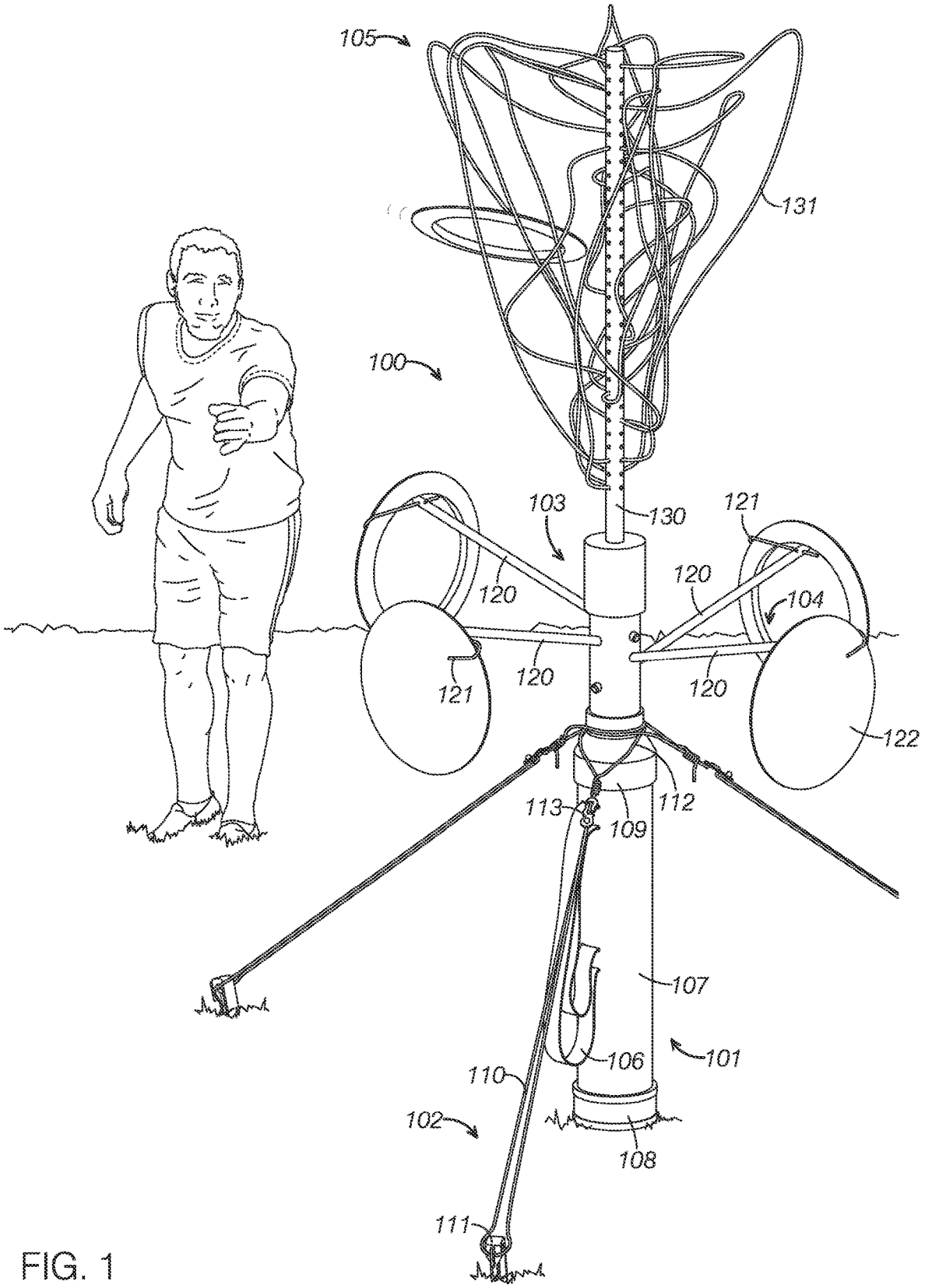
FIG. 1 is a view of a person throwing a flying disk into a loop target assembly of a toss game apparatus.

The disclosed toss game apparatuses and gameplay methods will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of toss game apparatus and gameplay method examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Toss Game Apparatuses and Gameplay Methods

With reference to the figures, toss game apparatuses and gameplay methods will now be described. The toss game apparatuses discussed herein function to provide a unique target for toss games. The toss game apparatuses are configured to disassemble into an easily portable, self-contained configuration.

The reader will appreciate from the figures and description below that the presently disclosed toss game apparatuses and gameplay methods address many of the shortcomings of conventional toss game apparatuses and gameplay methods.

For example, the novel apparatuses described below make it convenient to play toss games. With the novel apparatuses described herein, one does not have to travel to a dedicated Frisbee golf course to play a toss game. The novel toss game apparatuses discussed in this document are compact, lightweight, convenient, and easy to transport.

Unlike conventional toss games, such as Frisbee golf, the novel toss game methods discussed below do not require a high level of skill and have multiple ways to score points. The novel gameplay methods and unique apparatuses described herein provide new and exciting gameplay opportunities suitable for players of all ages and abilities.

Contextual Details

Ancillary features relevant to the toss game apparatuses described herein will first be described to provide context and to aid the discussion of the toss game apparatuses.

Tossed Object

The toss game apparatuses disclosed herein are often used with tossed objects as part of toss gameplay methods. The tossed objects are tossed towards the toss game apparatus with the goal of hitting defined portions of the apparatus with the tossed object.

The tossed object may be any currently known or later developed type of object that may be safely tossed. In the present example, the tossed object is a flying disk. In other examples, the tossed object is a ball, a dart, a filled bag, or a rigid elongate member, such as a stick.

Toss Game Apparatus Embodiment One

With reference to FIGS. 1-7, a first example of a toss game apparatus, toss game apparatus 100, will now be described. Toss game apparatus 100 includes a base 101, guide wire systems 102, a shoulder tube 103, target hanger systems 104, and a loop target assembly 105. In other examples, the toss game apparatus includes additional or alternative features.

In some examples, the toss game apparatus does not include one or more features included in toss game apparatus 100. For example, some toss game apparatus examples do not include guide wire systems.

Figure 2:
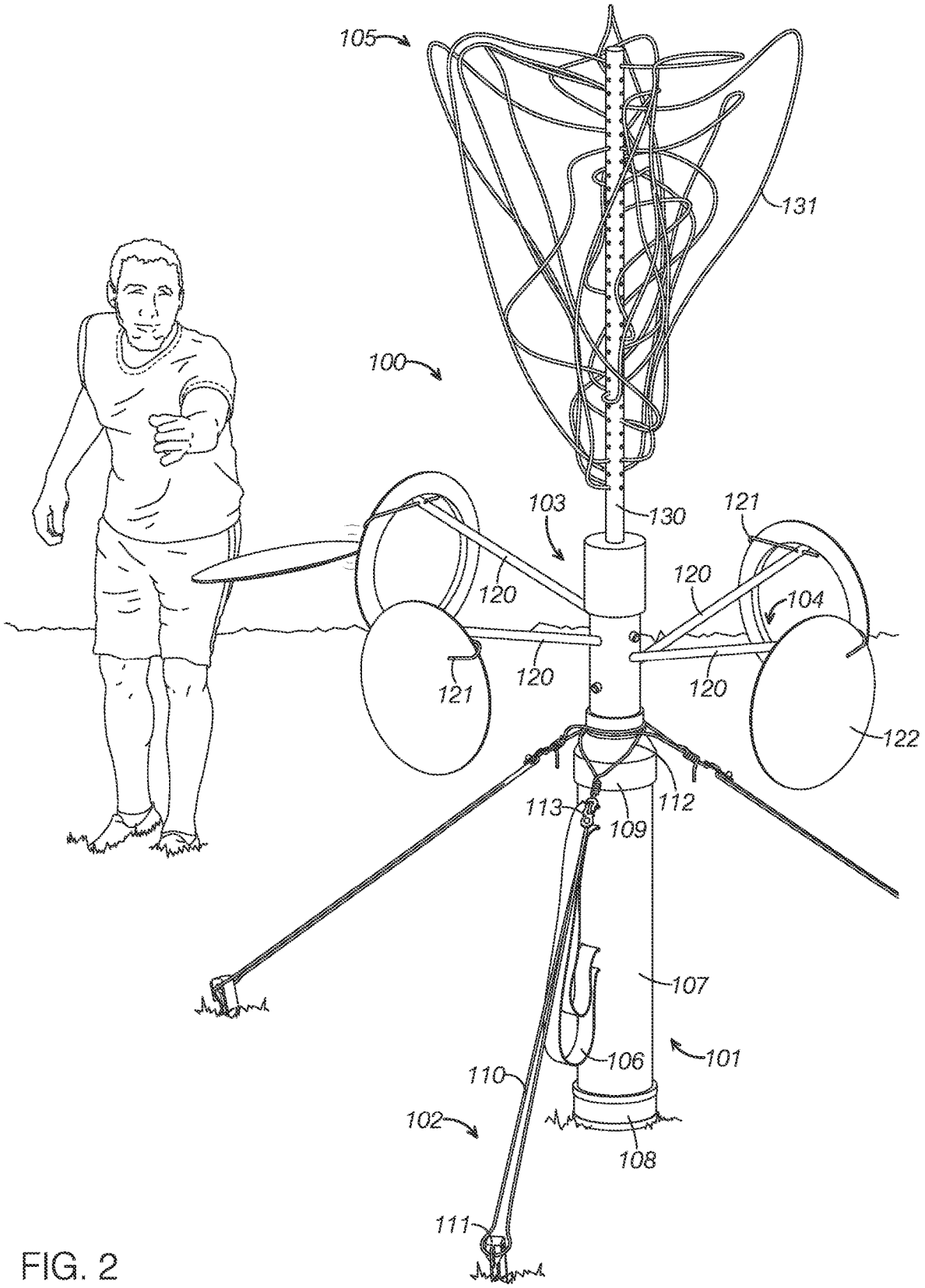
FIG. 2 is a view of a person throwing a flying disk at the toss game apparatus shown in FIG. 1 and knocking off a hanging target.
Figure 3:
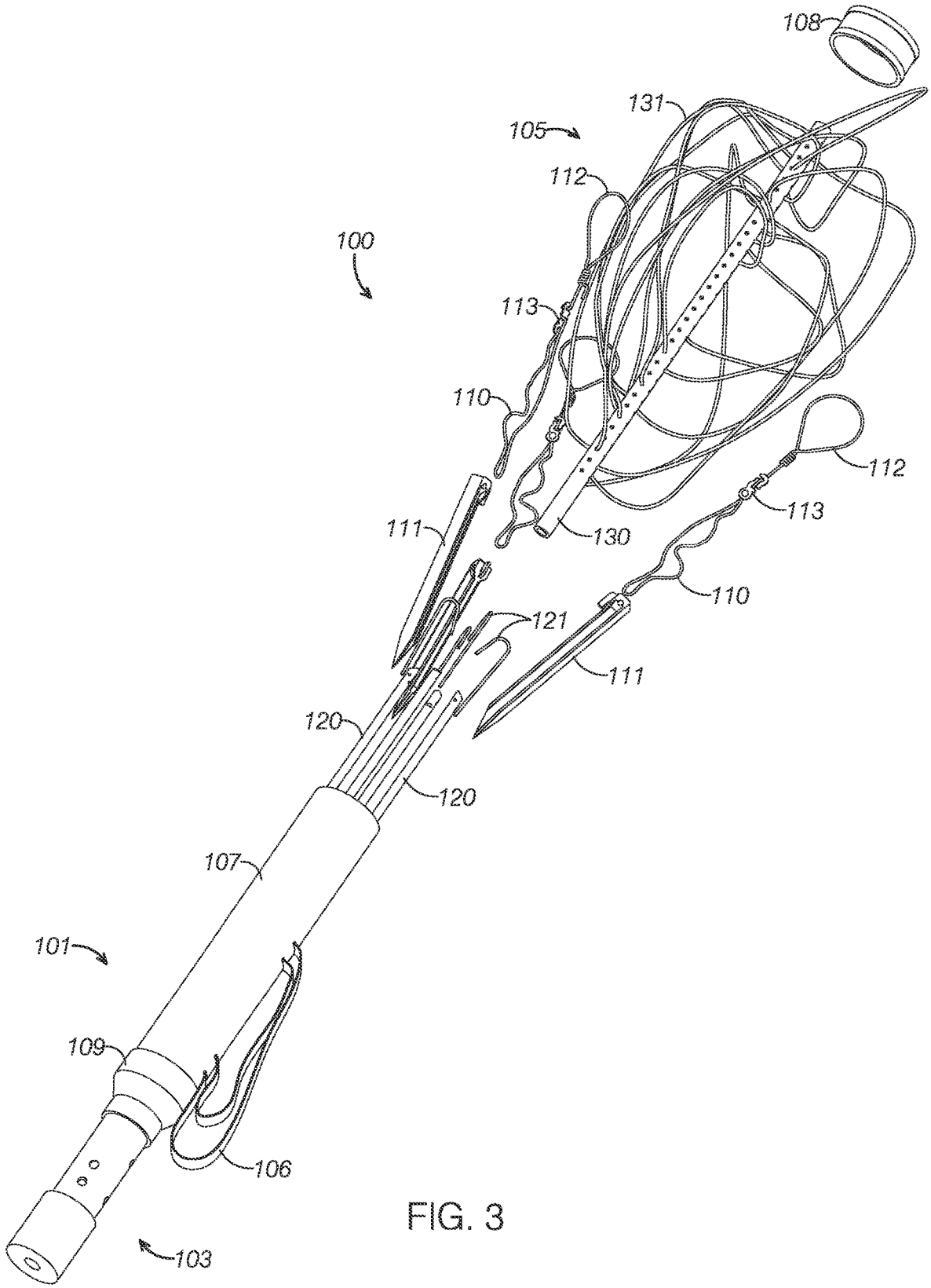
FIG. 3 is a view of the toss game apparatus shown in FIG. 1 in a disassembled state with components ready to insert into a storage compartment defined within a base member.
Figure 4:
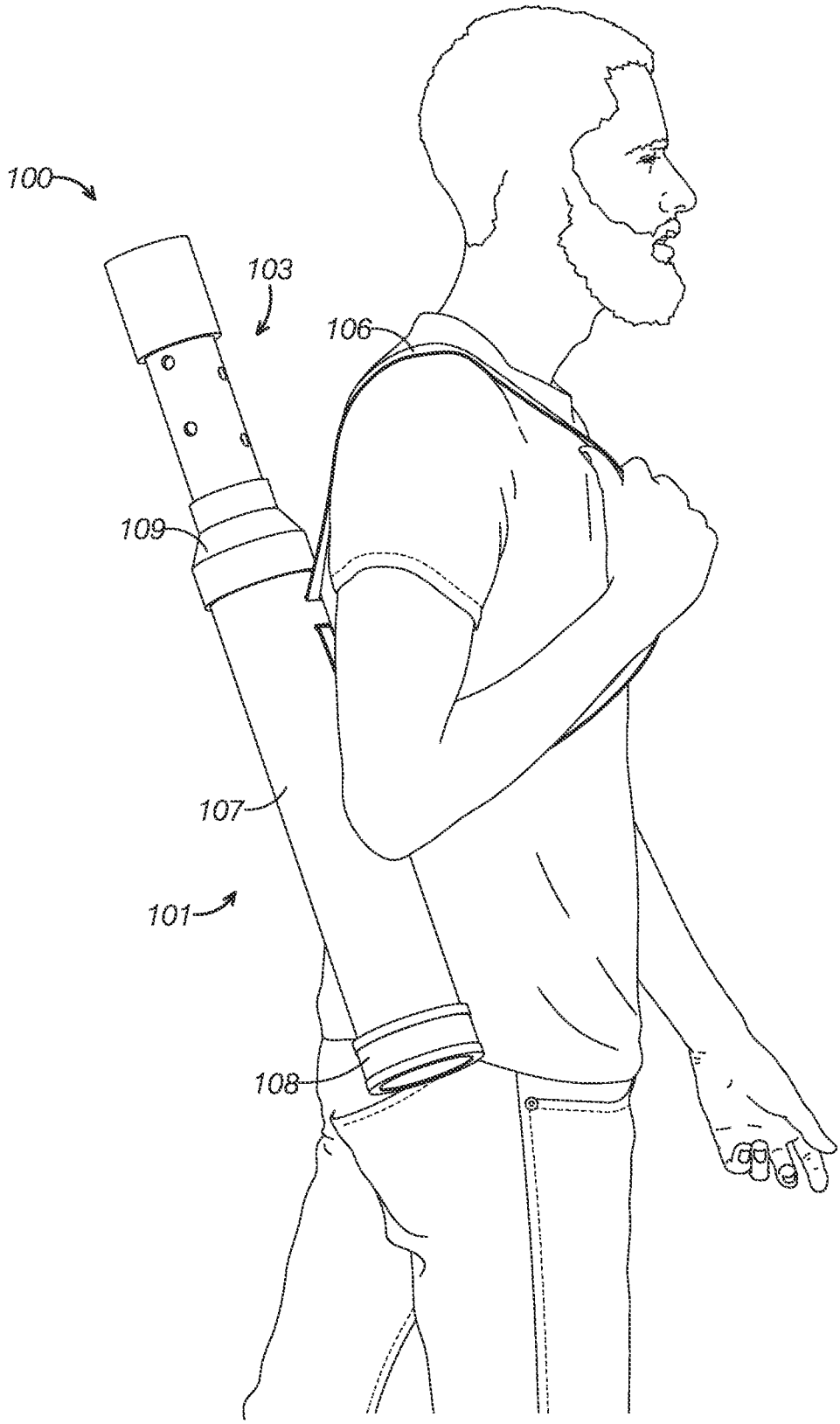
FIG. 4 is a view of a person carrying the toss game apparatus in a stowed configuration on his shoulder with a strap.
Figure 5:
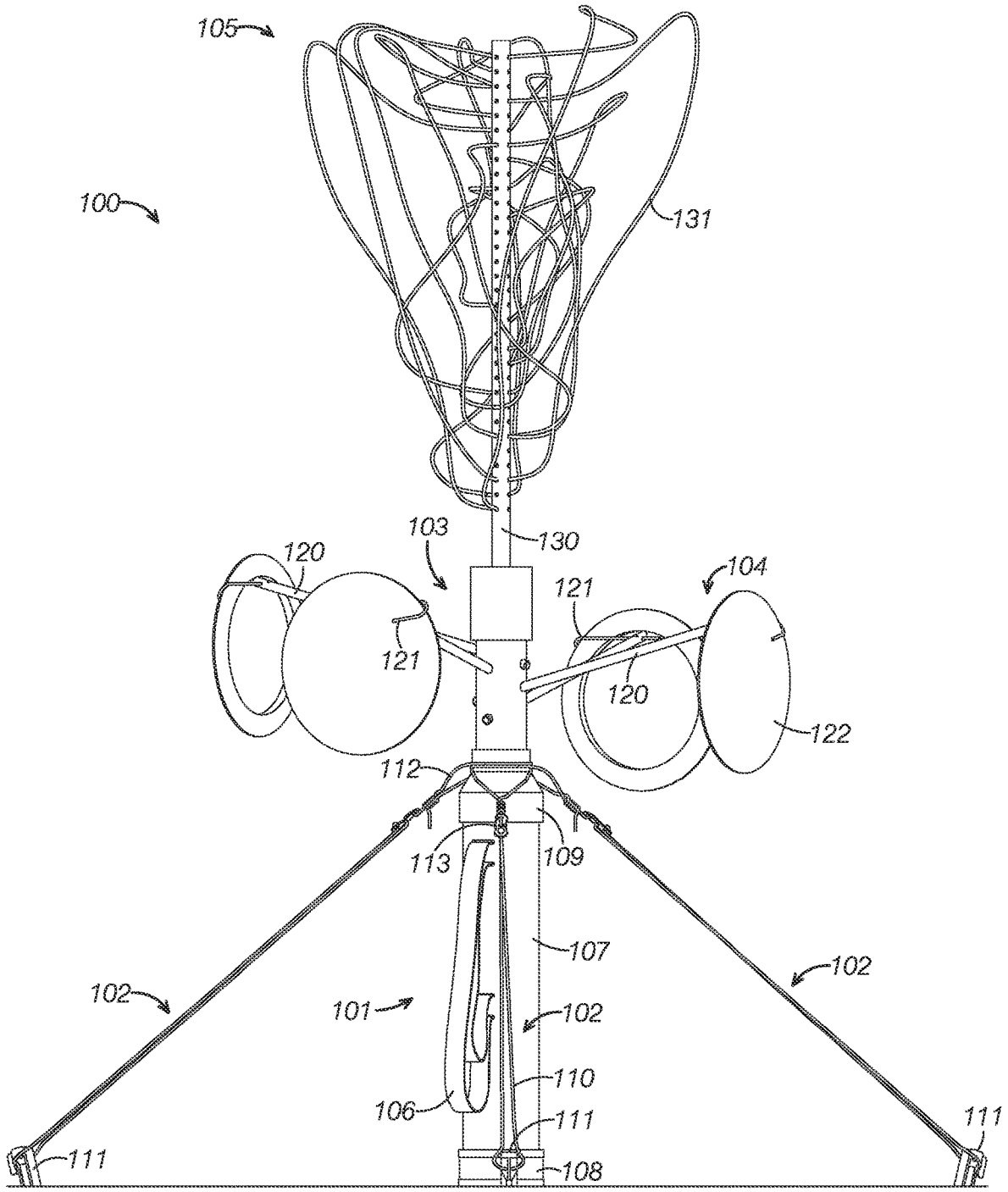
FIG. 5 is a front elevation view of the flying disk at the toss game apparatus shown in FIG. 1.

As shown in FIGS. 1, 2, and 5, base 101 functions to support other components of apparatus 100 from the ground. With reference to FIGS. 3 and 4, the reader can see that base 101 also functions to contain components of apparatus 100 when apparatus 100 is disassembled.

As can be seen in FIGS. 1, 2, and 5, base 101 is substantially cylindrical and oriented vertically from the ground when apparatus 100 is assembled for use. Guide wire systems 102 laterally stabilize base 101. Shoulder tube 103 is mounted on base 101. In some examples, the base and/or legs are solid.

Base 101 includes a tubular body 107, a cap 108, a tapered coupler 109, and a strap 106. Cap 108 is selectively coupled to a bottom end of tubular body 107 and tapered coupler 109 is coupled to a top end of tubular body 107 opposite the bottom end. When apparatus 100 is assembled and base 101 is oriented vertically, cap 108 rests on the ground and tubular body 107 extends up from cap 108 with tapered coupler 109 being disposed at the highest vertical position.

The reader can see in FIGS. 1, 2, and 5 that tapered coupler 109 tapers to a narrower diameter opposite cap 108. As discussed more fully below in the guide wire system section, the taper of tapered coupler 109 maintains support loop 112 at a top end of base 101 distal cap 108 and distal the ground. The taper of tapered coupler 109 also serves to enable shoulder tube 103 to threadingly couple to base 101 despite shoulder tube 103 having a narrower diameter than tubular body 107.

As shown in FIGS. 3 and 4, cap 108 is configured to selectively couple to tubular body 107 to selectively cover or provide access to the inside of tubular body 107. When apparatus 100 components are stored within tubular body 107, cap 108 may be secured to tubular body 107 to enclose tubular body 107 and to protect and maintain the components within tubular body 107.

The size and shape of the base may vary in different examples. In preferred examples, the size and shape of the base is selected to accommodate many of the components of the apparatus being stored within the base while being small enough to easily carry. As shown in FIGS. 6-10, most of the components of apparatus 100 fit within base 101 when apparatus is disassembled.

As shown in FIG. 4, base 101 is small enough for a person to easily carry. With continued reference to FIG. 4, the reader can see that base 101 in the present example includes an optional strap 106 coupled to tubular body 107. Strap 106 facilitates carrying base 101, either by holding strap 106 with one's hand or by placing strap 106 over one's shoulder.

In the present example, base 101 is formed from plastic, but may be formed from any material suitable for structural applications. Suitable materials include wood, metal, polymers, and composite materials.

Guide Wire Systems

As shown in FIG. 5, guide wire systems 102 function to laterally support base 101 and apparatus 100 as a whole. With continued reference to FIG. 5, each guide wire system 102 includes an elongate tension bearing member 110, an anchor 111, a support loop 112, and a tension adjuster 113. In some examples, the guide wire systems do not include a tension adjuster.

As can be seen in FIGS. 1, 2, and 5, toss game apparatus 100 includes three guide wire systems 102 oriented approximately 120 degrees apart around base 101. However, the apparatus may include more or less guide wire systems in other examples. In some examples, such as examples where the base provides sufficient stability on its own, the apparatus does not include guide wire systems.

As shown in FIGS. 1, 2, and 5, guide wire systems 102 extend from an anchor end to a support end opposite anchor end. Anchor 111 is coupled to elongate tension bearing member 110 at the anchor end and support loop 112 is formed from elongate tension bearing member 110 at the support end.

Each guide wire system 102 is anchored to the ground with anchor 111. Shoulder tube 103 is configured as a hammer to facilitate pounding anchor 111 into the ground. Support loop 112 is looped over tapered coupler 109 of base 101 to couple base 101 to the ground via elongate tension bearing member 110 and anchor 111. Once support loop 112 is looped over tapered coupler 109, tension adjuster 113 can be utilized to adjust the tension of elongate tension bearing member 110 between anchor 111 and support loop 112 looped around base 101.

The reader can see in FIG. 5 that tapered coupler 109 tapers to a narrower diameter opposite cap 108. The taper of tapered coupler 109 maintains support loop 112 at a top end of base 101 distal cap 108 and distal the ground.

Guide wire system 102 coupling to base 101 near the top of base 101 enhances the lateral stability provided by guide wire system 102 since guide wire system 102 is acting on a larger moment. Explained more fully, the reader can see in FIG. 1 that base 101 forms a moment arm relative to the ground with cap 108 as a pivot point. By coupling guide wire system 102 to tapered coupler 109 distal cap 108, guide wire system 102 exerts more lateral stabilizing force on base 101 than it would if it coupled to base 101 closer to the ground.

Shoulder Tube

As shown in FIGS. 1, 2, and 5, shoulder tube 103 functions to support target hanger systems 104 radially extending from shoulder tube 103. With further reference to FIGS. 1, 2, and 5, the reader can see that shoulder tube 103 supports loop target assembly 105. Shoulder tube 103 also serves as a hammer to pound anchors 111 into the ground.

As shown in FIGS. 1, 2, and 5, shoulder tube 103 threadingly and selectively couples to tapered coupler 109 of base 101. Shoulder tube 103 defines a plurality of side openings through which hangers 120 of target hanger systems 104 insert. Further, shoulder tube 103 defines a top opening through which a spine 130 of loop target assembly 105 inserts. Spine 130 abuts a topmost hanger 120 extending through shoulder tube 103 to be supported from below by hanger 120 while being laterally supported by the boundaries of the top hole of shoulder tube 103.

The size and shape of the shoulder tube may vary in different examples. In the present example, shoulder tube 103 is formed from plastic, but may be formed from any material suitable for structural applications. Suitable materials include wood, metal, polymers, and composite materials.

Target Hanger Systems

As shown in FIGS. 1, 2, 5, and 6, target hanger systems 104 serve to provide targets for a toss game. In particular, target hanger systems 104 provide target members 122 supported in a manner that causes target members 122 to fall to the ground when struck by a well-aimed tossed object in the toss game.

As shown in FIGS. 1, 2, 5, and 6, apparatus 100 includes four target hanger systems 104 spaced approximately 90 degrees apart around shoulder tube 103 in the present example. In other examples, the apparatus includes more or fewer target hanger systems.

Figure 6:
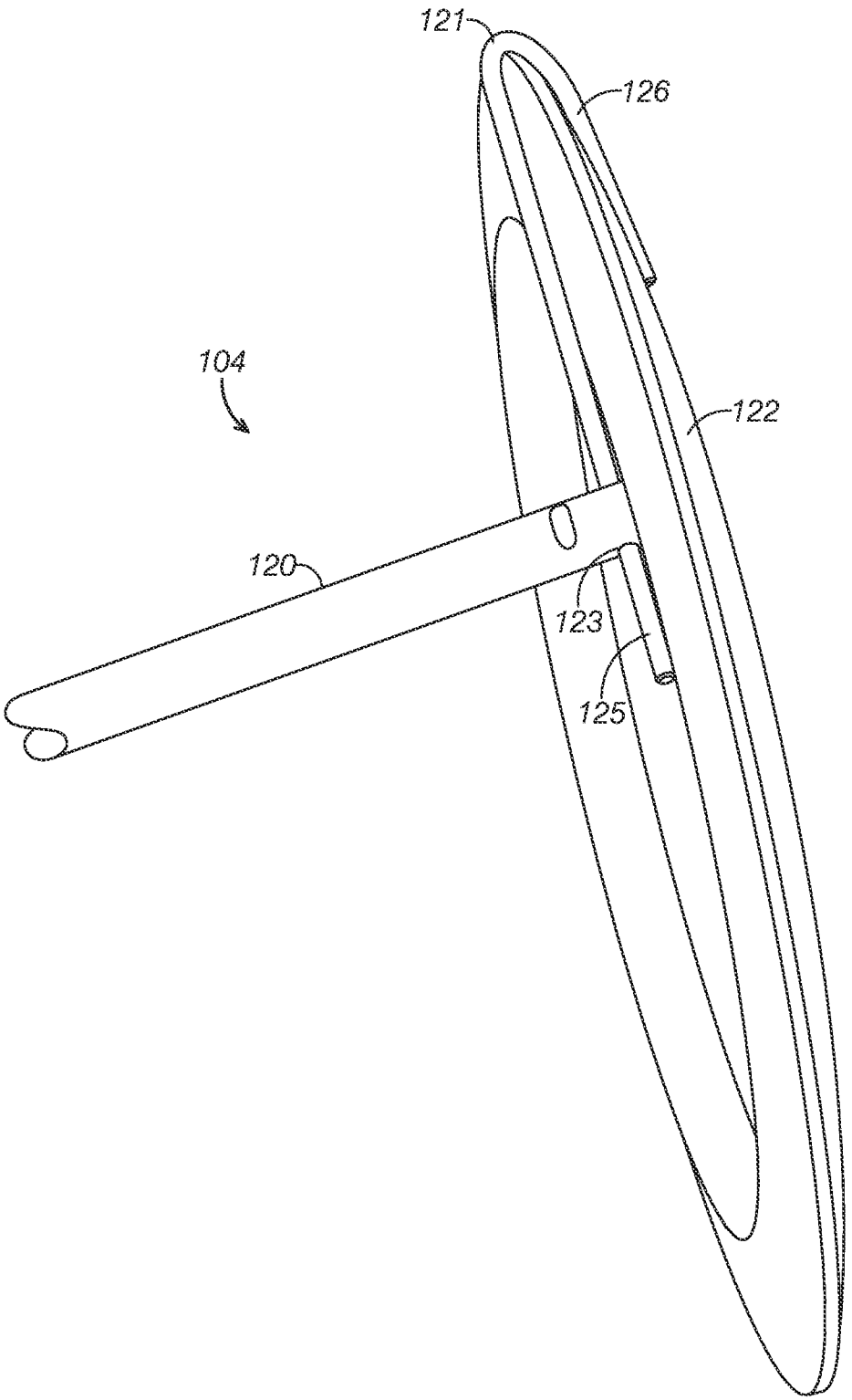
FIG. 6 is a close-up view of a target hanger system of the toss game apparatus shown in FIG. 1.

As shown in FIG. 6, each target hanger system 104 includes a hanger 120, a retainer 121, and a target member 122. Hanger 120 inserts into a side opening of shoulder tube 103 to extend radially from shoulder tube 103.

In some examples, the target hanger system includes a restriction element to restrict the hanger from passing more than a certain distance through the shoulder tube. The restriction element may be a rubber band, a boss, or a projection. The restriction element is disposed on the hanger proximate the shoulder tube and is larger than the side opening to restrict the hanger from passing further through the side opening when the restriction element abuts the shoulder tube at the side opening. In one specific example, the restriction element is a % inch diameter rubber band; however the size and shape of the restriction element may vary in other examples.

Figure 7:
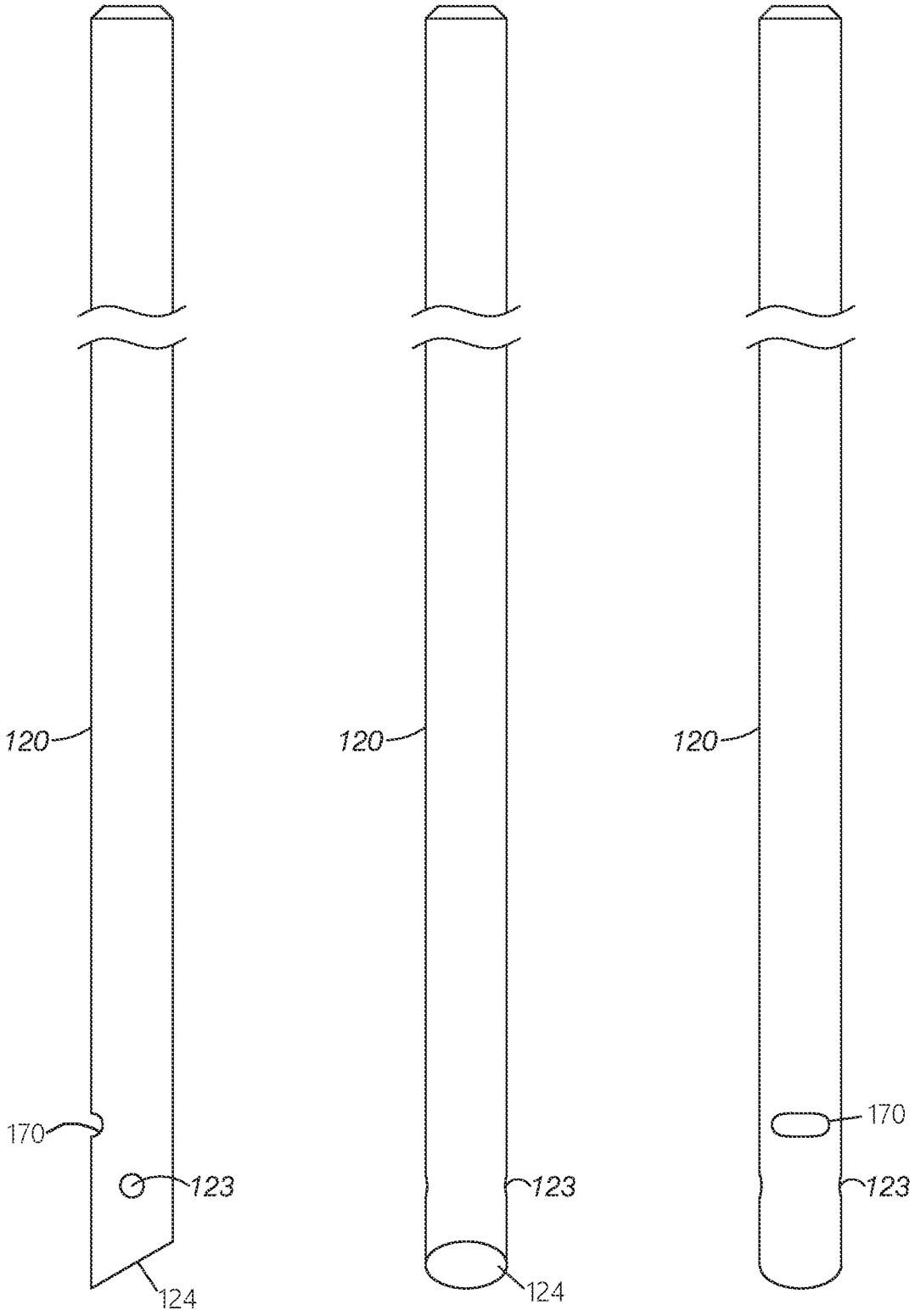
FIG. 7 is elevation views of a hanger of the target hanger system in three different orientations.

With reference to FIGS. 6 and 7, the reader can see that hanger 120 defines a retainer opening 123 distal shoulder tube 103. With further reference to FIG. 7, a target support end 124 of hanger 120 distal shoulder tube 103 and proximate retainer opening 123 is beveled to define an angled contact interface between a face of target support end 124 and a major face of target member 122.

As shown in FIG. 7, hanger 120 defines a notch 170 near retainer opening 123. Notch 170 is curved and formed by removing a radius of material from hanger 120. In the present example, notch 170 is formed by removing a radius of $1/8^{th}$ of an inch of material, but may be larger or smaller in other examples. Notch 170 is configured to support an optional makeshift floppy disk (not pictured) or other target item, such as a rope with a weight secured to the rope, sometimes referred to as a bola or ladder golf toss item. Not all examples of the hanger include a notch like notch 170.

As shown in FIG. 6, retainer 121 is configured as a hook with a shank 125 and a hook end 126. As shown in FIG. 3, shank 125 inserts through retainer opening 123. Retainer 121 is rotatingly supported within retainer opening 123. As shown in FIG. 5, hook end 126 is disposed proximate target support end 124 when shank 125 inserts through retainer opening 123.

Hook end 126 receives and surrounds a portion of target member 122 to support target member 122 resting on hanger 120. Hook end 126 helps maintain target member 122 on hanger 120 as wind blows against target member 122. However, hook end 126 and retainer 121 in general is configured to allow target member 122 to be knocked off hanger 120 when struck by a tossed object during gameplay.

As shown in FIGS. 1, 2, 5, and 6, target member 122 is a flying disk in the present example. However, the target member may be any object suitable for selectively resting on the hanger and being knocked off the hanger when struck by a tossed object. Target members in the form of flying disks are convenient because the tossed object is often a flying disc. It is envisioned that someone may have a set of flying disks and will use some of them as target members and others as tossed objects seeking to knock off the target members during gameplay.

Loop Target Assembly

Loop target assembly 105 provides an additional target beyond target hanger systems 104 for toss gameplay. As shown in FIGS. 1, 2, and 5, loop target assembly 105 is supported by shoulder tube 103 and extends vertically above the other components of apparatus 100.

With reference to FIGS. 1, 2, and 5, the reader can see that loop target assembly 105 includes a spine 130 and a plurality of loops 131. The loops are formed from strong, elongate tension bearing members. In the example shown in FIGS. 1, 2, and 5, the loops are formed from plastic cords, but may be formed from any suitable material, such as metal or plastic chains or natural or synthetic material cordage.

Each loop in plurality of loops 131 couples to spine 130 at two vertically spaced points. The two points can be randomly established during manufacturing. In the present example, the loops are multicolored, but may be a single color in other examples.

Spine 130 inserts into the top opening of shoulder tube 103 and rests on a topmost hanger 120 extending through shoulder tube 103. In this manner, spine 130 is supported from below by hanger 120 while being laterally supported by the boundaries of the top hole of shoulder tube 103.

The loops project out from spine 130 and provide targets for a tossed object. When one tosses an object and hits a loop, the person may score a point in a toss game.

The size and shape of the loop target assembly 105 may vary in different examples. In preferred examples, loop target assembly is large enough to provide a target large enough to hit from reasonable distances while being compact enough to fit within base 101 for storage and transport.

Assembly

The assembly of apparatus 100 will be briefly described. As discussed above and shown in FIGS. 3 and 4, apparatus 100 is configured to be self-contained within base 101 for storage and transport.

Assembling apparatus 100 typically begins with removing cap 108 from tubular body 107 and removing the components of apparatus 100 from within tubular body 107. Next, base 101 is positioned upright on the ground.

Thereafter, guide wire systems 102 are deployed to laterally support base 101. First, anchors 111 are pounded into the ground with shoulder tube 103 approximately 120 degrees apart around base 101. Second, support loops 112 are looped over tapered coupler 109. Finally, elongate tension bearing member 110 is tensioned with tension adjusters 113.

Shoulder tube 103 is coupled to tapered coupler 109 and hangers 120 are inserted into the side openings of shoulder tube 103. Target members 122 are hung from hangers 120 and retained on hangers 120 by retainers 121. Thereafter, loop target assembly 105 is inserted into the top hole of shoulder tube 103.

Gameplay Method

Apparatus 100 can be used as part of various toss gameplay methods. One example of a gameplay method is initially described here for illustrative purposes, but the reader should understand that the gameplay rules or steps may be modified to accommodate different gameplay style preferences and abilities. Further gameplay method concepts are described below.

Gameplay Method Example

Similar to the game of Frisbee golf, players may start at a given distance from apparatus 100 and throw flying disks or other toss objects towards apparatus. The starting position may be established by a selected player starting near apparatus 100 and throwing a flying disk or other object away from apparatus 100, with the starting position corresponding to where the flying disk lands. It may take multiple tosses to get close enough to apparatus 100 to successfully hit apparatus 100.

The gameplay method may include awarding points for successfully hitting loop target system 105 and/or target members 122 supported on hangers 120. Awarding points for hitting target members 122 may be limited to instances where the tossed object successfully knocks a target member 122 off a hanger 120. In some examples, more points are awarded for knocking target member 122 off hanger 120 than for hitting loop target system 105. Many other scoring variations are contemplated.

Additional Gameplay Method Concepts

The discussion below discusses additional gameplay method concepts. The discussion presents the concepts in a manner suitable for users seeking to understand and use the toss game apparatus rather than in a technical manner. The discussion below highlights concepts that may be presented with commercial embodiments of the toss game apparatus and the reader of this document should understand that the potential gameplay methods or configurations of the toss game apparatuses described above are not limited to the concepts below.

You get to throw 3 discs on your par shot. And only one on drive shots prior to par.

Points scored: Different options on how to score when putting your 3 discs.

First option (Upper Orb (Loop Target Assembly) shot): 1 point if you hit anything above the thin red line and no disc falls off. This includes the PVC vertical pole and Orb strings. Even if you just skim the spiraled Orb strings it counts as long as it moves.

Second option (A skilled shot): 2 points awarded for targeting and making a single disc fall by itself. Usually this means the player targets a single disc without hitting anything else.

Third option (Good luck shot): 3 points awarded if you throw and hit above the red line and the reaction causes one disc to fall by itself. Hence a good REACTION!!!

Penalties and/or No Points while Putting.

Sloppy shots: If you hit below the red line and make more than one disc but not all fall then you are not awarded any points for that throw but still continue as long as one disc is still hanging remaining.

Worst case penalty: If you hit below the red line and all remaining discs fall to the ground at once you lose all of the points for that round and your round is over without having the chance to throw more. This rule is to deter people from just hitting anywhere on the Orb.

Note: This THIN RED LINE can make a difference when you have good luck and bad luck when scoring. If you hit above the red line you are safe from penalty if more than one disc falls to the ground. Even if it means all the discs fall to the ground at once. Hitting above the red line is always the safe option.

Good Luck Scenarios for Putting on Par Shot.

Good luck scenario 1: You throw and hit anything below the red line but don't hit a disc directly. If only 1 disc falls by that reaction you are still awarded the 2 points for that throw. That scenario is kind of a sloppy shot but nevertheless you still only made one drop, so luck was on your side. ***Note: Guy lines are included as well if they are hit and make anything fall.

Good luck scenario 2: 3 points awarded for hitting the Orb above the red line and making a single disc fall off by the reaction. This type of shot requires a little luck from the reactor.

Bad Luck Scenarios for Putting on Par Shot.

Bad luck scenario 1: You throw a sloppy disc and hit below the red line and more than one disc falls, but not all of them, then you just don't get any points for that throw but you still get to continue.

Bad luck scenario 2: (The worst case scenario when putting on your par shots) You throw and hit below the red line and make all remaining discs fall at the same time. You lose all of your points for that round and stop playing for that round only. Be careful if there are only 2 discs remaining. If you have gained 4 points already it might be best to just take your chance with hitting the Orb strings and hope for a little luck. This is when strategy can come into play.

Drive Shots and Scoring Opportunity for Larger Playing Field.

Best shot scenario on a drive: When you are on your drive shots you only get to throw one disk per drive. If you hit the Orb on a drive shot then you can get 2 points for any disc dropped, 8 points max. You then count your points and continue with your putt shots at the upper Orb portion. With this rule there is no penalty on drive shots. If you play with drive shots then it is best to establish a putting zone with a radius. Walking paces is an easy way to do this. This entails walking paces for a measurement. For example If you land within 30 paces then you are in the putting circle. You can still lay up your remaining drive shot closer if you land in the putting circle but you don't have the opportunity to score points for any disc that falls off. When shooting a layup shot from inside the putting circle you must follow this next rule.

Alternative Rule for Layup Shots in the Putting Circle.

The throw must land past the perpendicular plane of the Orb from the throwers direction. If it doesn't cross the perpendicular plane then you lose a putt throw and now you are down to just 2 putts. Adjust this rule as needed per your skill level of players or don't even use it all . . . .

A challenge for a shootout can happen if a player thinks your paces are off or you didn't land past the imaginary line.) A shootout is explained later in detail.

A technicality for when attempting to hit the upper portion on putt shots to prevent people from just swinging and hitting the Orb if they land close enough. The throwing disc must release from the hand! This will prevent people from just swatting at it in the hopes of easy points.

*If a player lands close enough to touch a target disc on the Orb by stretching then you can take 2 points for that disc and without having to throw and knock it off but it is counted as one of your 3 discs and out of play. This rule saves the hassle of picking up a dropped disc and hanging it again. Make sure your feet don't go past the marker disc that landed. Sorry short people but the taller players have an advantage with this option. Feel free to make adjustments to this technicality if you all agree to it.*

Disclaimer about Hanging a Target Disc.

Target discs are meant to easily hop off the reactor rods so when you hang a disc it is best to seat as tight against the inside of the target disc as possible. The problem comes when you have to trust someone else to do this step like the player before you. The next player up can ask the person hanging the disc to make sure it is seated best by tapping it inward towards the center of the Orb. Keep in mind that a precariously hanging disc can be an advantage and also a disadvantage. A good seated disc is best. A customary rule is that you set the Orb back up for the next player in good faith. A fun rule to play with is that if the wind knocks off a single disc when the player's disc is in mid flight then 2 points are awarded no matter what if only one falls off. Nature was on your side. This rule can only take place during mid flight for a few seconds. If any disc falls off otherwise then they should be placed back before play can continue.

Setting Up the Playing Field and Fairways.

First and foremost please be respectful of your surrounding environment with people, pets, and property. When finding a place to play please be observant to any people that may walk into your throwing path while giving extra room for wide fairways. Shank shots can cause injury and damage so please be very safe and observant when thinking this through. Don't set up in areas with a lot of people!!! Ideal locations are large open areas with no one around except you the players. Always be observant to where your flight path will be for all levels of players. Don't ever set up a fairway on a blind corner or by other people's personal property.

You can reference the PDGA rules for setting par distances but it is really up to you and your teammates to determine what is par. Setting up the Orb Reactor in a central location can mean a multitude of fairway options for only one Orb Reactor. If you have more than one Orb you can set up an actual course. Establishing out of bounds requirements with "mandos" makes the game more fun. Any roadways or walking paths should always be considered out of bounds. Throwing over a pathway is highly discouraged as well.

To establish a par distance assuming you have plenty of land it is easiest to stand by the Orb and throw as far as you can and consider that one drive plus a little extra depending on your likings. For another drive, just keep going to make a longer par option. 2 par fairways are common. One drive shot and one putt opportunity. Or you can just pick a "tee pad" wherever you want and start playing. If you want to follow the PDGA rules for setting up par, there are publicly available reference guides for this.

Start of Play.

Once you have established the course and are ready to start, a good old game of Roshambo (Rock, paper, and scissors) can determine who goes first or have fun with a shootout. After play starts the person who scores the highest points will be the first to throw on the next "Tee pad" location, "Winner first losers last". The winner also can make a variation call to move the "Tee pad" with all players' approval. I.E: Just moving the tee pad by 10 feet from the original spot can make a big difference in your obstacles. First player drops a marker disc for that "Tee pad" and everyone has to throw from behind it within a foot's range.

Once play has started the player has to throw from behind the disc with both feet and your feet can not land past the marking disc from where you throw at any given time while putting. If such happens then that disc is removed from the round with no points and any disc that fell stays on the ground.

Play continues while observing all safety and regulations. Depending on your course, set up a point value for winning score. IE: 30 points first=winner.

Backyard or Confined Field Option with "Mandos."

If you don't have much room to play this game it can be played as a "short game". A "short game" can be played in a zigzag or even a triangular orientation as well. Just set up points to land past on your drive shots in order to make it to the Orb. I.E. First drive is past a predetermined point (Tree, bush, rock, etc.) and then you continue to the Orb. Multiple variations can be done utilizing this method to create more drive options in a smaller field like a back yard.

Shootout Challenge Option

Shoot out rules: A shootout is a rapid fire series of 3 shots. This means the player throwing can't hesitate between shots and they can't move their feet position at all once the first disc is thrown. The quicker the better.

Challenges have to be called out before the next throw if it is a string or line call. You can not back out of a challenge once said.

2 options for a shootout: 1) Pick a throwing spot and go individually for points; or 2) Western style shootout: Pace off in opposite directions from center to the pre-set marker discs on the ground on opposite sides and perform the old turn and draw method, and see who gets the most hits and points first. Draws and ties go to the current player and not the challenger. If the challenger wins then they choose the outcome.

Challenge Option Scenarios.

A player challenges your skim hit on the Orb strings. A player challenges your drive shot on how many paces away it is. A player challenges you that you didn't cross the perpendicular plane for a layup. Note a shootout can take place for any decision making process as well as who goes first to start the game.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A toss game apparatus, comprising:

a base member;

a shoulder tube detachably mounted to the base member and extending away from the base member;

a target hanger system selectively mounted to the shoulder tube and projecting away from the shoulder tube, the target hanger system configured to releasably support a hanging target until the hanging target is struck by a tossed object to release the hanging target; and a loop target assembly selectively mounted to the shoulder tube above the target hanger system, wherein the loop target assembly includes:

a spine extending from the base member; and a cord secured to the spine at each terminal end of the cord to define a loop target.

2. The toss game apparatus of claim 1, wherein the base member includes a tubular body and defines a storage compartment within the tubular body.

3. The toss game apparatus of claim 2, wherein toss game apparatus is configured to selectively disassemble with the base member, the target hanger system, and the loop target assembly, selectively separated from each other.

4. The toss game apparatus of claim 3 wherein:

the target hanger system is complementarily configured with the tubular body; and the target hanger system is configured to selectively fit within the storage compartment for storage and transport.

5. The toss game apparatus of claim 4, wherein:

the loop target assembly is complementarily configured with the tubular body; and the loop target assembly is configured to selectively fit within the storage compartment for storage and transport.

6. The toss game apparatus of claim 5, wherein the base member includes a strap attached to the tubular body to facilitate carrying the base member with the target hanger system and the loop target assembly contained within the storage compartment.

7. The toss game apparatus of claim 2, wherein:

the base member includes a cap selectively coupled to the tubular body; and selectively removing the cap provides access to the storage compartment.

8. The toss game apparatus of claim 1, wherein:

the shoulder tube defines a side opening; and the target hanger system is mounted to the side opening.

9. The toss game apparatus of claim 8, wherein the target hanger system includes:

a hanger selectively mounted in the side opening;

a retainer mounted to the hanger distal the shoulder tube and configured to releasably support the hanging target until the hanging target is struck by a tossed object.

10. The toss game apparatus of claim 9, wherein:

the target hanger system further includes the hanging target; and the hanging target is a flying disk.

11. The toss game apparatus of claim 10, wherein:

the flying disk includes:

a circular rim; and a flight plate disposed inside the circular rim;

the circular rim rests on the hanger; and the retainer abuts the flight plate to restrict the flying disk moving sufficient for the circular rim to slip off the hanger in response to wind and allowing the flying disk to move sufficient for the circular rim to slip off the hanger when the flying disk is struck by a tossed object.

12. The toss game apparatus of claim 11, wherein:

the hanger defines a retainer opening; and the retainer includes:

a shank that selectively inserts into the retainer opening; and a hook end extending from the shank and abutting the flight plate;

the retainer opening defines a bearing adapted to allow the shank to rotate within the retainer opening.

13. The toss game apparatus of claim 1, wherein the shoulder tube is configured to be used as a hammer when selectively removed from the tubular body.

14. The toss game apparatus of claim 1, further comprising a guide wire system configured to selectively support the base member in an upright orientation.

15. The toss game apparatus of claim 14, wherein the guide wire system includes:

an elongate tension bearing member selectively secured to the base member; and an anchor coupled to the elongate tension bearing member distal the base member and configured to be driven into the ground.

16. The toss game apparatus of claim 15, wherein:

the elongate tension bearing member forms a support loop distal the anchor by the elongate tension bearing member looping back on itself at with a first portion of the elongate tension bearing member and a second portion of the elongate tension bearing member coming together at a loop neck; and the support loop is secured around the base member.

17. The toss game apparatus of claim 16, wherein the guide wire system further includes a tension adjuster at the loop neck and configured to restrict the first portion and the second portion of the elongate tension bearing member moving relative to each other with a selected amount of tension in the elongate tension bearing member between the base member and the anchor.

18. The toss game apparatus of claim 16, wherein:

the base member includes:

a tubular body;

a tapered coupler mounted to the tubular body and reducing the diameter of the base member distal the tubular body; and the shoulder tube mounted to the tapered coupler; and the support loop is secured around the tapered coupler.

19. The toss game apparatus of claim 1, wherein:

the loop target assembly includes a plurality of cords coupled to the spine around the circumference of the spine in addition to the cord;

each cord in the plurality of cords is configured the same as the cord;

the plurality of cords defines a plurality of loop targets.

* * * * *